US010734731B2

(12) United States Patent
Sepänniitty et al.

(10) Patent No.: US 10,734,731 B2
(45) Date of Patent: Aug. 4, 2020

(54) ANTENNA ASSEMBLY FOR CUSTOMIZABLE DEVICES

(71) Applicant: Suunto Oy, Vantaa (FI)

(72) Inventors: Mikko Sepänniitty, Vantaa (FI); Panu Perko, Vantaa (FI); Eero Varjonen, Vantaa (FI); Erik Lindman, Vantaa (FI)

(73) Assignee: Suunto Oy, Vantaa (FI)

( * ) Notice: Subject to any disclaimer, the term of this patent is extended or adjusted under 35 U.S.C. 154(b) by 0 days.

(21) Appl. No.: 16/164,856

(22) Filed: Oct. 19, 2018

(65) Prior Publication Data

US 2019/0058256 A1 Feb. 21, 2019

Related U.S. Application Data

(63) Continuation-in-part of application No. 14/839,928, filed on Aug. 29, 2015, now Pat. No. 10,594,025, (Continued)

(30) Foreign Application Priority Data

| | | |
|---|---|---|
| Feb. 8, 2018 | (FI) | 20185115 |
| Feb. 8, 2018 | (FI) | 20185116 |
| Feb. 8, 2018 | (GB) | 1802093.3 |
| Feb. 8, 2018 | (GB) | 1802094.1 |

(51) Int. Cl.
*H01Q 1/24* (2006.01)
*H01Q 13/10* (2006.01)
(Continued)

(52) U.S. Cl.
CPC ..... *H01Q 13/106* (2013.01); *H01Q 1/2283* (2013.01); *H01Q 1/273* (2013.01);
(Continued)

(58) Field of Classification Search
CPC ..... H01Q 1/243; H01Q 13/10; H01Q 9/0421; H01Q 21/28; H01Q 21/30; H01Q 1/48; H01Q 1/521; H01Q 5/40; H01Q 1/2266; H01Q 9/16; H01Q 1/22; H01Q 1/242; H01Q 1/273; H01Q 3/08; H01Q 1/084;
(Continued)

(56) References Cited

U.S. PATENT DOCUMENTS

| | | | |
|---|---|---|---|
| 3,976,121 | A | 8/1976 | Johnson |
| 5,280,646 | A | 1/1994 | Koyama et al. |

(Continued)

FOREIGN PATENT DOCUMENTS

| | | | |
|---|---|---|---|
| CN | 204116829 | U | 1/2015 |
| CN | 104659493 | A | 5/2015 |

(Continued)

*Primary Examiner* — Linh V Nguyen
(74) *Attorney, Agent, or Firm* — Laine IP Oy

(57) ABSTRACT

The invention concerns an assembly for an antenna, wherein the assembly comprises at least one circuit board of an electronic device, a conductive body arranged at a distance from said at least one circuit board, and an element of said antenna which comprises multiple attachment points for at least one connecting member, and said at least one connecting member is coupled to only one of said multiple attachment points at a time.

25 Claims, 10 Drawing Sheets

Related U.S. Application Data which is a continuation of application No. 14/195,670, filed on Mar. 3, 2014, now Pat. No. 9,647,338, which is a continuation-in-part of application No. 13/794,468, filed on Mar. 11, 2013, now Pat. No. 10,079,428.

(51) Int. Cl.

| | |
|---|---|
| ***H01Q 1/22*** | (2006.01) |
| ***H01Q 13/18*** | (2006.01) |
| ***H01Q 1/27*** | (2006.01) |
| ***H01Q 7/00*** | (2006.01) |
| ***H01Q 9/04*** | (2006.01) |
| ***H01Q 5/385*** | (2015.01) |

(52) U.S. Cl.
CPC ..... *H01Q 5/385* (2015.01); *H01Q 7/00* (2013.01); *H01Q 9/0421* (2013.01); *H01Q 13/18* (2013.01)

(58) Field of Classification Search
CPC ..... H01Q 1/244; H01Q 9/32; H01Q 1/12; H01Q 9/44
USPC ..... 343/718, 767, 872, 702
See application file for complete search history.

(56) References Cited

U.S. PATENT DOCUMENTS

| | | | | |
|---|---|---|---|---|
| 5,673,054 | A | 9/1997 | Hama | |
| 5,754,143 | A | 5/1998 | Warnagiris et al. | |
| 5,946,610 | A | 8/1999 | Hama | |
| 6,373,439 | B1 | 4/2002 | Zuercher et al. | |
| 6,853,605 | B2 | 2/2005 | Fujisawa et al. | |
| 7,151,496 | B2 | 12/2006 | Casagrande | |
| 7,215,600 | B1 | 5/2007 | Derosa | |
| 7,271,774 | B2 * | 9/2007 | Puuri | H01Q 1/273 343/718 |
| 8,243,442 | B2 | 8/2012 | Hobson et al. | |
| 9,450,297 | B2 | 9/2016 | Sepänniitty et al. | |
| 9,640,858 | B1 * | 5/2017 | Islam | H01Q 21/20 |
| 9,647,338 | B2 | 5/2017 | Nissinen et al. | |
| 10,079,428 | B2 | 9/2018 | Nissinen et al. | |
| 10,271,299 | B1 * | 4/2019 | Sayem | H01Q 1/273 |
| 10,594,025 | B2 | 3/2020 | Nissinen et al. | |
| 2002/0008663 | A1 | 1/2002 | Suguro et al. | |
| 2004/0108861 | A1 | 6/2004 | Germiquet et al. | |
| 2005/0054321 | A1 * | 3/2005 | Casagrande | H01Q 1/273 455/351 |
| 2005/0174294 | A1 | 8/2005 | Peroulis et al. | |
| 2005/0219955 | A1 | 10/2005 | Xu et al. | |
| 2005/0243486 | A1 | 11/2005 | Wingfiel et al. | |
| 2006/0097918 | A1 | 5/2006 | Oshiyama et al. | |
| 2006/0227058 | A1 | 10/2006 | Zellweger | |
| 2007/0146218 | A1 | 6/2007 | Turner et al. | |
| 2008/0150816 | A1 | 6/2008 | Rahola et al. | |
| 2008/0291591 | A1 | 11/2008 | Huang et al. | |
| 2009/0256758 | A1 | 10/2009 | Schlub et al. | |
| 2009/0312655 | A1 | 12/2009 | Lo | |
| 2009/0312656 | A1 | 12/2009 | Lau et al. | |
| 2010/0023095 | A1 | 1/2010 | Stevenson et al. | |
| 2010/0238080 | A1 | 9/2010 | Lindberg et al. | |
| 2011/0013491 | A1 | 1/2011 | Fujisawa | |
| 2011/0051561 | A1 | 3/2011 | Fujisawa | |
| 2011/0102274 | A1 | 5/2011 | Fujisawa | |
| 2011/0128200 | A1 | 6/2011 | Hossain et al. | |
| 2011/0148723 | A1 | 6/2011 | Bengtsson | |
| 2011/0316751 | A1 | 12/2011 | Jarvis et al. | |
| 2012/0105288 | A1 | 5/2012 | Abe | |
| 2012/0105888 | A1 | 5/2012 | Nakayama | |
| 2012/0120772 | A1 * | 5/2012 | Fujisawa | G04C 10/02 368/64 |
| 2012/0146865 | A1 | 6/2012 | Hayashi et al. | |
| 2013/0181873 | A1 | 7/2013 | Gutschenritter et al. | |
| 2013/0210297 | A1 | 8/2013 | Maas et al. | |
| 2014/0085153 | A1 | 3/2014 | Nagahama | |
| 2014/0085154 | A1 | 3/2014 | Nagahama | |
| 2014/0139637 | A1 | 5/2014 | Mistry et al. | |
| 2014/0159989 | A1 | 6/2014 | Malek et al. | |
| 2014/0182148 | A1 * | 7/2014 | Heikkinen | G01C 17/28 33/303 |
| 2014/0225786 | A1 | 8/2014 | Lyons et al. | |
| 2014/0232603 | A1 | 8/2014 | Fujisawa | |
| 2014/0240181 | A1 * | 8/2014 | Mamuro | H01Q 1/24 343/702 |
| 2014/0253150 | A1 | 9/2014 | Menzel et al. | |
| 2014/0253393 | A1 | 9/2014 | Nissinen et al. | |
| 2014/0253394 | A1 | 9/2014 | Nissinen et al. | |
| 2014/0266920 | A1 * | 9/2014 | Tran | H01Q 1/243 343/702 |
| 2014/0266938 | A1 | 9/2014 | Ouyang et al. | |
| 2014/0306859 | A1 | 10/2014 | Desclos et al. | |
| 2014/0323063 | A1 | 10/2014 | Xu et al. | |
| 2014/0333494 | A1 | 11/2014 | Huang | |
| 2015/0048979 | A1 | 2/2015 | Asrani et al. | |
| 2015/0109172 | A1 | 4/2015 | Iijima | |
| 2015/0188217 | A1 | 7/2015 | Tsai et al. | |
| 2015/0220066 | A1 | 8/2015 | Fujisawa | |
| 2015/0349410 | A1 * | 12/2015 | Russell | H01Q 1/273 343/702 |
| 2016/0006109 | A1 | 1/2016 | Apaydin et al. | |
| 2016/0006110 | A1 * | 1/2016 | Jain | H01Q 5/328 343/702 |
| 2016/0036120 | A1 | 2/2016 | Sepänniitty et al. | |
| 2016/0056533 | A1 | 2/2016 | Nissinen et al. | |
| 2016/0099497 | A1 | 4/2016 | Lee | |
| 2016/0308272 | A1 | 10/2016 | Standke et al. | |
| 2016/0344096 | A1 | 11/2016 | Erentok | |
| 2017/0179581 | A1 | 6/2017 | Puuri et al. | |
| 2017/0187096 | A1 | 6/2017 | Hwang et al. | |
| 2017/0214422 | A1 * | 7/2017 | Na | H04B 1/385 |
| 2018/0129168 | A1 | 5/2018 | Chan | |
| 2018/0287248 | A1 | 10/2018 | Han et al. | |
| 2018/0356861 | A1 | 12/2018 | Ichikawa et al. | |
| 2019/0058256 | A1 | 2/2019 | Sepänniitty et al. | |
| 2019/0072912 | A1 | 3/2019 | Pandya et al. | |
| 2019/0210703 | A1 | 7/2019 | Sepänniitty et al. | |
| 2019/0265655 | A1 | 8/2019 | Naka et al. | |

FOREIGN PATENT DOCUMENTS

| | | | |
|---|---|---|---|
| CN | 204424456 | U | 6/2015 |
| CN | 105093908 | A | 11/2015 |
| CN | 105785757 | A | 7/2016 |
| CN | 104638361 | B | 3/2017 |
| EP | 0745915 | A2 | 12/1996 |
| EP | 0871238 | A2 | 10/1998 |
| EP | 1178374 | A2 | 2/2002 |
| EP | 1689023 | A1 | 8/2006 |
| EP | 1806276 | A2 | 7/2007 |
| EP | 2019448 | A1 | 1/2009 |
| EP | 2056395 | A1 | 5/2009 |
| EP | 2317602 | A1 | 5/2011 |
| EP | 3242357 | A1 | 11/2017 |
| FI | 20155124 | A | 9/2015 |
| GB | 2089075 | A | 8/1982 |
| GB | 2276274 | A | 9/1994 |
| GB | 2431522 | A | 4/2007 |
| JP | H04227301 | A | 8/1992 |
| JP | H08330826 | A | 12/1996 |
| JP | 2002261533 | A | 9/2002 |
| JP | 3611591 | B2 | 1/2005 |
| JP | 2009229368 | A1 | 10/2009 |
| WO | WO2004038856 | A1 | 5/2004 |
| WO | WO2011000438 | A1 | 1/2011 |
| WO | WO 2016167914 | A1 | 10/2016 |
| WO | WO2017088164 | A1 | 6/2017 |
| WO | WO2018183678 | A1 | 10/2018 |
| WO | WO2019135856 | A1 | 7/2019 |

* cited by examiner

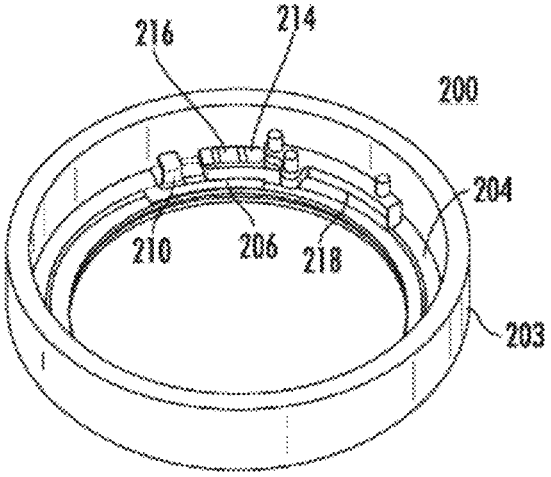
FIG. 13A
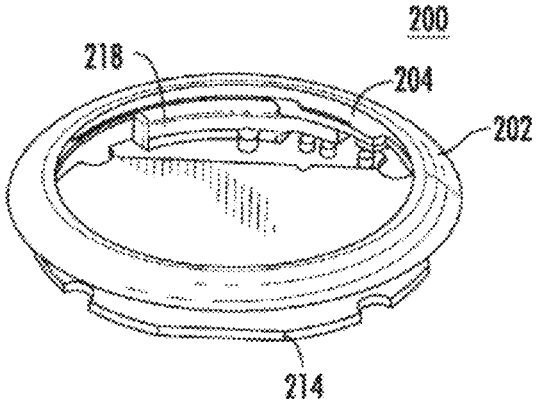
FIG. 13B
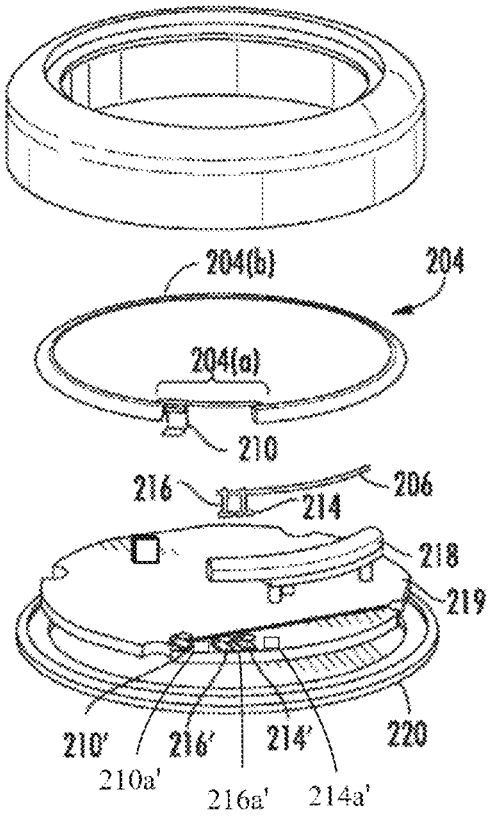
FIG. 13C
FIG. 13

ANTENNA ASSEMBLY FOR CUSTOMIZABLE DEVICES

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

TECHNOLOGICAL FIELD

The present disclosure relates generally to an antenna assembly for use in electronic devices such as wireless or portable radio devices. More specifically, the present disclosure relates to an antenna assembly which enables customization of electronic devices comprising the antenna assembly.

BACKGROUND OF THE INVENTION

Antenna assemblies are commonly found in most modern radio devices, such as mobile computers, portable navigation devices, mobile phones, smartphones, personal digital assistants (PDAs), wristwatches or other personal communication devices (PCD). Typically, these antenna assemblies comprise a planar radiating element with a ground plane that is generally parallel to the planar radiating element. The planar radiating element and the ground plane are typically connected to one another via a short-circuit conductor in order to achieve the desired impedance matching for the antenna. The structure is configured so that it functions as a resonator at the desired operating frequency. Typically, these internal antennas are located on a printed circuit board (PCB) of the radio device inside a plastic enclosure that permits propagation of radio frequency waves to and from the antenna(s).

More recently, it has become desirable to make it possible for the customers to customize devices. A wearable or wrist worn radio device may comprise a bezel and other parts, such as, a casing, which may be changed depending on the customer's needs and wishes. However, changing of some parts of radio devices may affect the performance of the device. Thus, if for example a bezel is changed, the radio device may not meet regulatory radio requirements anymore, unless the radio device is adjusted otherwise. However, current antenna assemblies do not enable cost-efficient customization of certain parts of wearable or wrist worn radio devices.

Accordingly, there is a salient need for an antenna assembly for use with a wearable or wrist worn radio device, which enables customization of the device cost-efficiently.

SUMMARY OF THE INVENTION

An antenna assembly may be created by a bezel made of a conductive material, such as a metal, and the periphery of a printed circuit board itself. The inventors of the present disclosure have made the surprising observation that an antenna assembly may be made tunable for various devices, by having an antenna element comprising multiple, i.e., at least two, attachment points for at least one connecting member, wherein the at least one connecting member is coupled to only one of the multiple attachment points at a time. In general, a connecting member may be referred to as a connecting pin or connecting element as well.

This offers significant advantages as, for example, the same printed circuit board may be used for different device variants of one product family. The inventive antenna assembly may be particularly advantageous for wearable or wrist worn radio devices, to optimize the radiation pattern and therefore the reception of, for example, GNSS (Global Navigation Satellite System) signals for dedicated uses and sports, e.g. for running, walking or cycling. GNSS systems include, but are not limited to, GPS, Glonass, Galileo and Beidou navigation systems. In addition, the inventive antenna assembly may be advantageous at least for reception of Wi-Fi and Bluetooth signals as well.

According to a first aspect, there is provided an assembly for an antenna, wherein the assembly comprises at least one circuit board of an electronic device, a conductive body arranged at a distance from said at least one circuit board, and an element of said antenna which comprises multiple attachment points for at least one connecting member, and said at least one connecting member may be coupled to only one of said multiple attachment points at a time.

According to the first aspect, the assembly may comprise at least two connecting members and said element of said antenna may comprise multiple attachment points for each of the at least two connecting members.

According to the first aspect, said antenna may operate in a slot mode and said element of said antenna may be said at least one circuit board, comprising said multiple attachment points at which said at least one circuit board may be connectable to said conductive body.

According to the first aspect, said antenna may be operating in a slot mode and said element of said antenna may be said conductive body, comprising said multiple attachment points at which said conductive body is connectable to said at least one circuit board.

According to the first aspect, the assembly may further comprise at least one conductive rim structure located along at least part of the periphery of said at least one circuit board, and said element of said antenna may be said at least one conductive rim, comprising said multiple attachment points at which said at least one circuit board may be connectable to said conductive body.

According to the first aspect, between said attachment points of said at least two connecting members may be located at least one feed element for coupling an electromagnetic signal between at least one slot mode antenna and said circuit board.

According to the first aspect, said element of said antenna may be a plastic part comprising said multiple attachment points at which said conductive body may be connectable to said at least one circuit board or to at least one conductive rim.

According to the first aspect, said connecting member may comprise a connection point for grounding said conductive body to a ground plane of said circuit board and/or a slot defining member serving as grounding pins and defining the ends of the slot antenna.

According to the first aspect, the assembly may further comprise at least one elongate strip of a conductive material and said element of said antenna may be said at least one circuit board comprising said multiple attachment points at which said at least one elongate strip may be connectable to said at least one circuit board.

According to the first aspect, said connecting member may comprise a short circuit point associated with a middle radiating element, galvanic feed point associated with an inner feed element and/or a ground point associated with the inner feed element.

According to the first aspect, conductive body may be a bezel being a part of the housing encompassing a wristwatch-like device.

According to the first aspect, said conductive body may have the shape of a ring, an ellipse, a rectangle, a square, or any other polygon.

According to the first aspect, the assembly may be adapted for the reception of a GNSS (Global Navigation Satellite System), Wi-Fi or Bluetooth signal.

According to the first aspect, said GNSS signal may be selected from GPS, Glonass, Galileo and/or Beidou signals.

According to a second aspect, there is provided an electronic wristwatch-like device comprising at least one circuit board, a conductive body arranged at a distance from said at least one circuit board, and an element of said antenna which comprises multiple attachment points for at least one connecting member, and said at least one connecting member is coupled to only one of said multiple attachment points at a time.

According to the second aspect, the device may comprise at least two connecting members and said element of said antenna comprises multiple attachment points for each of the at least two connecting members.

According to the second aspect, said antenna may be operating in a slot mode and said element of said antenna is said at least one circuit board, comprising said multiple attachment points at which said at least one circuit board may be connectable to said conductive body.

According to the second aspect, said antenna may be operating in a slot mode and said element of said antenna may be said conductive body, comprising said multiple attachment points at which said conductive body may be connectable to said at least one circuit board.

According to the second aspect, the device may further comprise at least one conductive rim structure located along at least part of the periphery of said at least one circuit board, and said element of said antenna may be said at least one conductive rim, comprising said multiple attachment points at which said at least one circuit board may be connectable to said conductive body.

According to the second aspect, between said attachment points of said at least two connecting members may be located at least one feed element for coupling an electromagnetic signal between at least one slot mode antenna and said circuit board.

According to the second aspect, said element of said antenna may be a plastic part comprising said multiple attachment points at which said conductive body may be connectable to said at least one circuit board or to at least one conductive rim.

According to the second aspect, said connecting member may comprise a connection point for grounding said conductive body to a ground plane of said circuit board and/or a slot defining member serving as grounding pins and defining the ends of the slot antenna.

According to the second aspect, the device may further comprise at least one elongate strip of a conductive material and said element of said antenna may be said at least one circuit board comprising said multiple attachment points at which said at least one elongate strip may be connectable to said at least one circuit board.

According to the second aspect, said connecting member may comprise a short circuit point associated with a middle radiating element, galvanic feed point associated with an inner feed element and/or a ground point associated with the inner feed element.

According to the second aspect, said conductive body may be a bezel being a part of the housing encompassing the wristwatch-like device.

According to the second aspect, said conductive body may have the shape of a ring, an ellipse, a rectangle, a square, or any other polygon.

According to the second aspect, the device may be adapted for the reception of a GNSS (Global Navigation Satellite System), Wi-Fi or Bluetooth signal.

According to the second aspect, said GNSS signal may be selected from GPS, Glonass, Galileo and/or Beidou signals.

According to a third aspect, there is provided an electronic wristwatch-like device comprising the antenna assembly of the first aspect.

The inventive antenna assembly and wristwatch device is characterized by what is set forth in the appended claims. Further features of the present disclosure, its nature and various advantages will be more apparent from the accompanying drawings and the following detailed description.

BRIEF DESCRIPTION OF THE DRAWINGS

The features, objectives and advantages of the present disclosure will become more apparent from the detailed description set forth below, when taken in conjunction with the drawings, wherein:

FIG. 13A illustrates a perspective view of the underside of a coupled antenna apparatus of a radio device in accordance with some embodiments of the present invention;

FIG. 13B illustrates a perspective of the coupled antenna apparatus of FIG. 13A in accordance with some embodiments of the present invention;

FIG. 13C illustrates an exploded view of the coupled antenna apparatus of FIGS. 13A and 13B, detailing various components of the coupled antenna apparatus, in accordance with some embodiments of the present invention.

DETAILED DESCRIPTION OF EMBODIMENTS

Figure 1:
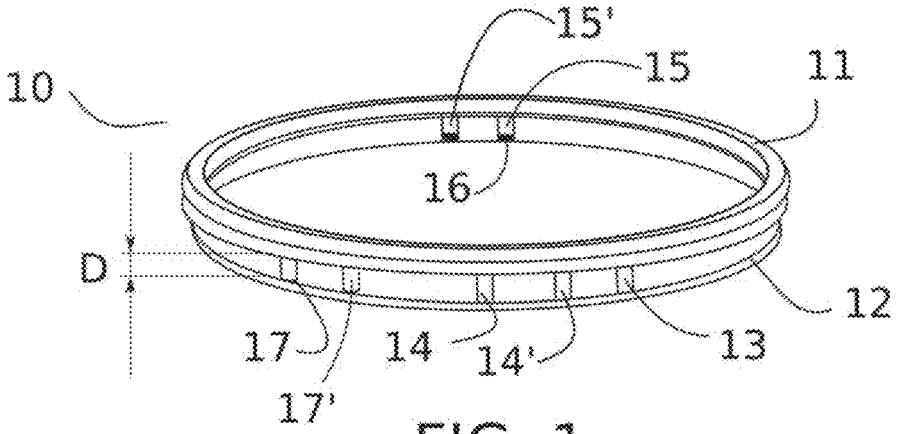
FIG. 1 presents an exemplary assembly for an antenna operating in a slot mode, in accordance with some embodiments of the present invention.

Embodiments of the present invention enable optimization of an antenna assembly for various customizable devices, such as, wearable or wrist worn radio devices. For example, if an antenna assembly of a device wearable or wrist worn radio device comprises a slot mode antenna, lengths and dimensions of the slots may be adjusted, even though only one printed circuit board (PCB) would be used for different variants in one product family. A PCB may be referred to as a circuit board in general. The present invention thereby enables the use of different, customized bezels and other parts of the device, such as metallic buttons, for one product family while ensuring that the antenna assembly may meet regulatory requirements and antenna performance requirements, for all the variants of the radio device within the product family.

Embodiments of the present invention are not restricted to slot mode antennas though, and may be exploited at least in the context F-antennas as well, known for example from U.S. patent application Ser. No. 13/794,468. In U.S. Ser. No. 13/794,468 the F-antenna structure may be installed beneath a bezel and it may connect to a PCB. Embodiments of the present invention also enable tuning of the F-antenna, using only one PCB for different variants within one product family. In addition, embodiments of the present invention may be used at least for L-antennas. An L-antenna may be referred to as an F-antenna without a ground connection.

In previous antenna assemblies, a distance between connection points, or connecting members, e.g., pogos has been fixed. Therefore the previous antenna assemblies have not been tunable for different devices in one product family. That is to say, the previous antenna assemblies have not been adjustable for different device variants, but embodiments of the present invention enable customization by varying/changing the distance between connecting members. For example, in case of slot mode antennas tuning may be done by changing the size of the slot while in case F- or L-antennas tuning may be done by changing the distance between radiating elements.

Customization may be seen as a competitive advantage. A customer may want to build a customized device out of many variants, which then needs to be manufactured. In general, it would be desirable to use same parts for different variants, as much as possible, to be able to manufacture customized devices cost-efficiently. Embodiments of the present invention enable the use of, for example, the same PCB for different device variants, even though different bezels or other parts of the device would be used for the customized devices within one product family. According to the embodiments of the present invention it would be possible to avoid ordering of different PCBs by using the same PCB for different variants, which would reduce costs compared to ordering different PCBs for all variants.

As an example, different bezels may have different shapes which define placement of connecting members, e.g., pogos, that are connected to both, to a bezel and a PCB. There may also be different plastic parts which affect the placement. The bezel, the PCB and the plastic parts may be referred to as antenna elements in general. A bezel may take the shape of a ring, an ellipse, a square, a rectangle, or any other polygon, for example. The shape of the PCB would then need to be designed accordingly.

In case of slot mode antennas, an edge of a slot may be formed with the help of connecting members such as, for example, pogos, spring taps or sheet metal parts. A bezel may have a shape which defines a place of a connecting member. Moreover, a bezel and a PCB may comprise attachments points for the connecting members. Hence, the locations of the connecting members and attachment points would need to be changed for changing the slot size. Nevertheless, according to the embodiments of the present invention the PCB may be the same because it may comprise multiple locations, i.e., attachment points, for each connecting member. The PCB may comprise an area for various locations of the attachment points. One PCB may be, for example, related to a certain product family and have a structure, wherein the connecting members (e.g. pogos) are attachable to various locations which define the electrical length of the slot mode antenna assembly. Other antenna elements, e.g., a bezel or plastic parts of the device, may also comprise multiple attachment points for connecting members.

A connecting member may be for connecting two antenna elements. Said two antenna elements may comprise a circuit board, a conductive body and/or a conductive rim. In some embodiments, said two antenna elements may comprise a middle radiating element, galvanic feed point associated with an inner feed element and/or a ground point associated with the inner feed element. Also, in some embodiments an antenna element may comprise an elongate strip. A connecting member may be referred to as an electrically conductive component for connecting two antenna elements as well.

According to some embodiments of the present invention, an antenna assembly may comprise an element of an antenna which may change the length of the slot by providing multiple attachment points for at least one connecting member. The connecting member may be for example a pogo or a sheet metal part with more than one version of sheet metal parts with different distance.

For example, the plastic part may place the pogo, or there may be various attachment points in different places, and then a spring, e.g., a coil spring for making the connection. That is to say, there may be more than one possible location for one connecting member on the PCB, for connecting the bezel and the PCB, to enable multiple device variants in one product family. Also, the bezel or a plastic part between the bezel and the PCB may have more than one attachment point for each connecting member. The plastic part may be referred to as a ring between the bezel and the PCB or a housing which encompasses the bezel.

FIG. 1 presents an exemplary assembly for an antenna operating in a slot mode, in accordance with some embodiments of the present invention. The exemplary assembly of FIG. 1 comprises a printed circuit board (PCB) 12 for a device, such as a sports watch or smart watch, and a body, such as a ring-formed bezel 11, made of a conductive material and arranged on top of and in parallel to the PCB 12. The gap having a distance D between them defines a slot that enables the assembly 10 to act as an antenna in a slot mode. The periphery of the PCB 12 is at least partly aligned with the outer shape of the bezel 11, and has at least along a part of the periphery a metallic layer (see FIG. 3, item 33) connected to the ground plane of the PCB 12.

The exemplary assembly in FIG. 1 further comprises a feed element or pin 13 for coupling an electromagnetic signal between the slot mode antenna and the PCB 12. In the embodiment shown in FIG. 1, the feed element 13 is coupled between the bezel 11 and the PCB 12. The element 13 may be implemented in a variety of ways, as a pin or pogo stick, simply as a jumper connection, or as a stud on the PCB making contact with the slot mode antenna structure at the edge of the PCB, possibly with a via conducting the signal further in a multilayer PCB, for example. Any of this variety of solutions may be used in any embodiment of the present invention, as required by design, manufacturing and signal gain considerations.

Pins 14 and 15 are connection points for grounding the conductive body 11 to a ground plane of the circuit board. Pins 14 and 15, i.e., connection points, may be referred to as connecting members as well. Conductive body 11 and/or PCB 12 may comprise at least two attachment points for each of pins 14 and 15. The distance between the connection points 14 and 15 defines the length of the slot. The pins may be a simple jumper wire, or a spring loaded contact (pogo) pin, for example. The feed pins are preferably attached to the outer edge of the PCB, bezel or other structure to which it is intended to make an electrical connection with, to facilitate easy tuning. Also other attachment points than the edges are possible, but may require more tuning of other related components.

In some embodiments of the present invention, the PCB 12 may comprise multiple attachment points for both, connecting members 14 and 15, to enable adjusting lengths of the slots and dimensions of the antenna assembly by using only one PCB 12 for different product variants. Hence the PCB 12 may support various devices, wherein different bezels and/or other antenna elements are used. The present invention thereby enables the use of the same PCB in a certain product family, and the locations of the connecting members may be changed depending on the customization by attaching the connecting members to different attachment points.

According to some embodiments, pins 14 and 15 are to be considered as the physical representation of the connection points that connect the conductive body 11 to a ground plane of the PCB 12. The pins may in some embodiments be integral parts of an insulating element (not shown) that is located between the PCB and the conductive body, as a support or otherwise. In some embodiments, however, the elements containing the pins may be separate and located at the first and second ends of said slot to thereby define the slot antenna.

The assembly may in some embodiments have floating or insulated support pins (not shown) or an insulating ring that maintains the gap between the bezel 11 and PCB 12. Alternatively, or in addition, the pin 15 may be connected to ground via a frequency selective circuit (e.g. a low-pass filter) or an electronic switch 16. Thereby the same feed pin 13 may be configured to feed the same slot assembly with two different slot lengths, a shorter between pins 14 and 15 and a longer between pin 14 and 17. Such an arrangement would make the antenna slot selectable or switchable and thus suitable for two different frequencies, as the electrical length of the slot seen by the feed point 13 is determined by pin 14 (counterclockwise) to pin 15 on one hand or by pin 14 to pin 17 on the other hand.

Pin 17 may be referred to as a connecting member as well. In FIG. 1, second attachment points 14', 15' and 17' correspond to connecting members 14, 15 and 17, respectively. However, the second attachment points 14', 15' and 17' are different compared to the first attachment points 14, 15 and 17. Thus the use of second attachment points 14', 15' and 17' provides different slot lengths, which makes the assembly suitable for different frequencies. In the example of FIG. 1, conductive body 11 and/or PCB 12 may comprise two attachment points for each connecting member, but each connecting member is coupled to only one of the two attachment points at a time.

Conductive body 11 and/or PCB 12 may comprise more than two attachment points for each connecting member as well. In some embodiments of the present invention only PCB 12 may comprise multiple attachment points for each connecting member while conductive body 11 comprises only one attachment point. So for example, if conductive body 11 is a bezel, it may be changed to another bezel with different attachment points while the same PCB could support both bezels, as long as the attachment points of the both bezels match to the attachment points of the PBC. This way different bezels may be used for one device family with variants and one PCB may support all the variants within the product family.

Therefore, according to some embodiments of the present invention, an assembly for an antenna operating in a slot mode may comprise at least one PCB 12, a conductive body 11 arranged at a distance from said at least one circuit board and defining a slot between them, wherein a length of the slot is defined between two connecting members 14, 15, 17 at which said conductive body 11 is connected to a ground plane of said at least one circuit board 12, and wherein between said connecting members is located at least one feed element 13 for coupling an electromagnetic signal between said slot mode antenna and said PCB 12.

Figure 2:
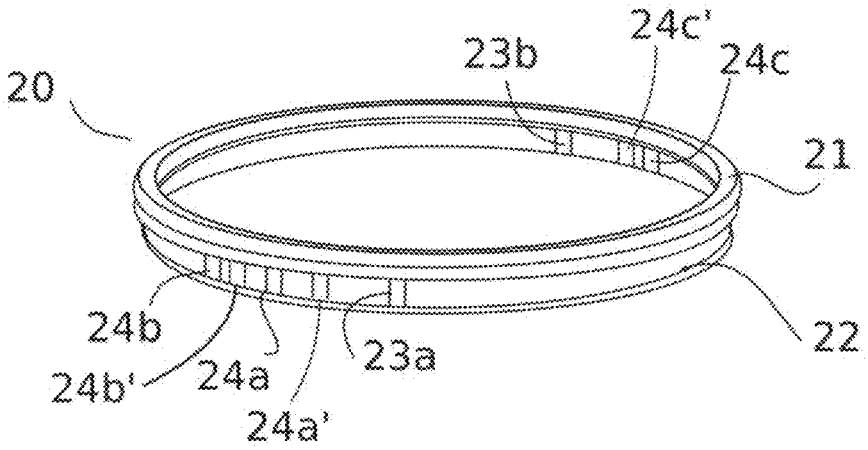
FIG. 2 presents an exemplary assembly for an antenna operating in a slot mode, according to some embodiments of the present invention.

FIG. 2 presents an exemplary assembly for an antenna operating in a slot mode, according to the principles of some further embodiments of the present invention. In FIG. 2, a similar assembly 20 is shown as in FIG. 1, but provided with two sections of the bezel 21 coupled separately to the PCB 22, thus providing two antennas operating in the slot mode. The length of a first slot mode antenna is defined by the section (counterclockwise) between the connection points or pins 24*a*-24*c* of the bezel 21, and the length of a second slot mode antenna may be defined by the section between pins 24*c*-24*b*, correspondingly. Thus, a first slot mode antenna has grounding pins 24*a* and 24*c*. The feed element or pin 23*a*, may be located between the grounding pins, as shown. Also in the example of FIG. 2 pins 24*a*-24*c* may be referred to as connecting members.

A second slot mode antenna has a grounding pin 24*b* and a feed pin 23*b* located close to its second grounding pin 24*c*, as shown. Also in this case there may second attachment points for connecting members 24*a*', 24*b*' and 24*c*', which correspond to 24*a*, 24*b* and 24*c*, respectively. As in the example of FIG. 1, the second attachment points for connecting members 24*a*', 24*b*' and 24*c*' may be different compared to the attachment points of connecting members 24*a*, 24*b* and 24*c*, thereby providing different slot lengths. Again, conductive body 11 and/or PCB 12 may comprise two attachment points for each connecting member, but each connecting member is coupled to only one of the two attachment points at a time.

With different lengths of the bezel sections assigned to different antennas, they become tunable to different operating frequencies, and the electronic device they are connected to will thus be able to operate as a multi-band device.

A ground plane on a printed circuit board (PCB) may be a large area or layer of copper foil connected to the circuit's ground point, usually one terminal of the power supply. It serves as the return path for current from many different components. A ground plane is often made as large as possible, covering most of the area of the PCB which is not occupied by circuit traces.

A large area of copper also conducts the large return currents from many components without significant voltage drops, ensuring that the ground connection of all the components are at the same reference potential. In digital and radio frequency PCBs, a reason for using large ground planes is to reduce electrical noise and interference through ground loops and to prevent crosstalk between adjacent circuit traces.

Figure 3:
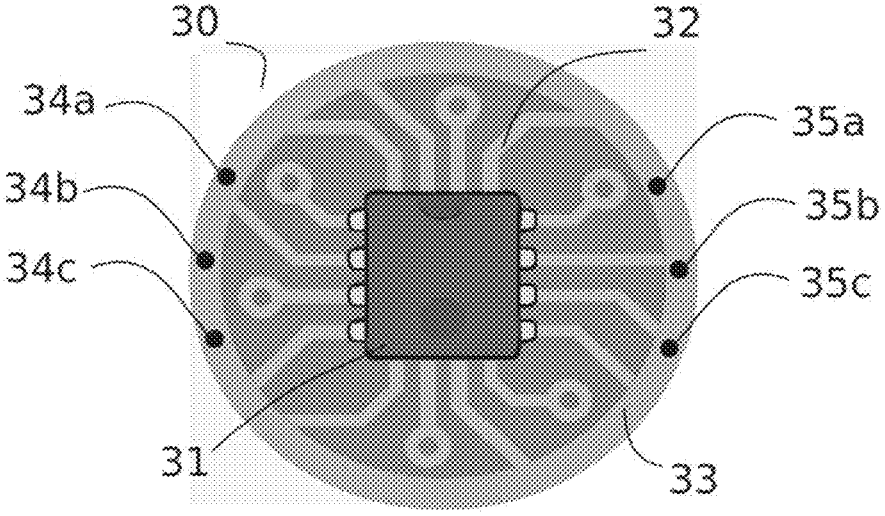
FIG. 3 presents a circular PCB that may be used with at least some embodiments of the present invention.

FIG. 3 presents a circular PCB that may be used with at least some embodiments of the present invention. In FIG. 3 is shown, for illustrative purposes, a typical circular PCB 30, with a microcontroller or -processor 31 and some copper wiring 32. According to an exemplary embodiment of the invention, the ground plane may be arranged as a copper brim 33 around the periphery of a circle-shaped PCB 30. This ensures the operation of an inventive slot-mode antenna as shown in FIGS. 1 and 2.

In FIG. 3, attachment points 34*a*, 34*b* and 34*c* demonstrate the multiple attachment points for a first connecting member. According to some embodiments of the present invention, the first connecting member may be coupled to only one of attachment points 34*a*, 34*b* and 34*c* at a time. Similarly, attachment points 35*a*, 35*b* and 35*c* demonstrate the multiple attachment points for a second connecting member and the second connecting member may be coupled to only one of attachment points 35*a*, 35*b* and 35*c* at a time.

The processor 31 may comprise, for example, a single- or multi-core processor wherein a single-core processor comprises one processing core and a multi-core processor comprises more than one processing core. A processing core may comprise, for example, a Cortex-A8 processing core manufactured by ARM Holdings or a Steamroller processing core produced by Advanced Micro Devices Corporation. The processor 31 may comprise at least one Qualcomm Snapdragon and/or Intel Atom processor. Processor 31 may comprise at least one application-specific integrated circuit, ASIC. Processor 31 may comprise at least one field-programmable gate array, FPGA. Processor 31 may be means for performing method steps in the PCB 30.

Figure 4:
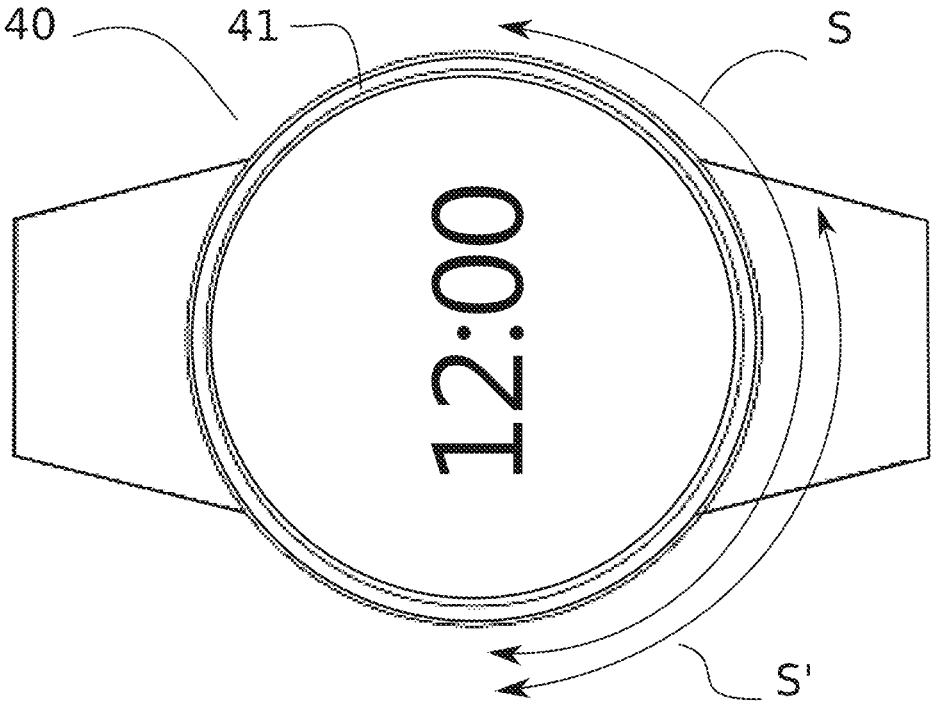
FIG. 4 shows an electronic wristwatch-like device mode in accordance with at least some embodiments of the present invention.

FIG. 4 shows an electronic wristwatch-like device mode in accordance with at least some embodiments of the present invention. In FIG. 4 is schematically shown an electronic wristwatch-like device 40 from above. A metallic bezel 41 encompasses the housing. Normally, during running and worn on the wrist, the device has a slot antenna running along the edge of the device, that is positioned mainly on a semi-circle sector having an arc length S between 3 and 9 o'clock. The radiation pattern of the antenna is then pointing upwards towards the sky, i.e. a satellite constellation.

The angular width (here used as a synonym to a central angle from the midpoint of a circle) of the slot antenna depends on the diameter of the device and on the materials used, where parameters such as the permittivity of dielectric materials affect the result. The angular width may be larger or narrower than the suggested 180°, resulting in FIG. 4 in the arc length S between 3 and 9 o'clock. S may be written as $$S = \frac{\alpha}{180}\pi R,$$

where S is the arc length, $\alpha$ is the central angle (in degrees) of a circle sector having the arc length S, and R is the radius of the same circle, here a circle-shaped slot antenna. The smaller the diameter of the device, the larger the angular width a should be in order to yield a specific arc length S.

In FIG. 4 is also indicated a narrower sector S' of some 120° between 5 and 9 o'clock, approximately. The inventors have found, in contrary to prior art solutions where feed pins are usually placed in the center of the slot antenna, that the polarization characteristics of the inventive antenna assembly is working optimally, for devices carried on the wrist and when walking and/or running, if the feed pin (see FIGS. 1 and 2) between the PCB and the bezel is located in a sector which is at a distance no further than a quarter to a third of the total slot antenna length, counted from the start of the antenna. The starting point is here at the 9 o'clock position. With the positioning of the feed pin, an optimal impedance match for the antenna at the GPS resonant frequency is sought. Less tuning of other components may then be necessary in order to achieve optimum reception of the GPS or other satellite systems signals.

Generally, the feed pin or a feed connection point can be on either the bezel side of the slot or on the PCB edge side of the slot. However, the preferred placement of the feed pin is often on the bezel, in order to achieve optimal antenna radiation. PCB placement may be favored by its mechanical simplicity and can be chosen if good enough antenna performance is achievable.

The Right Hand Circular Polarization (RHCP) component of the radiation pattern seem then to have a desired dominant peak that is pointing upwards, when the device is carried on the wrist (usually the left wrist). The achievable optimum radiation pattern is partly dependent on the device, i.e. the size of the device and the impedance of the slot antenna, and partly on the incoming signal direction and polarization. The latter requires that the slot antenna and its radiation field should be facing at least partly upwards in the mainly used GNSS reception use position.

Figure 5:
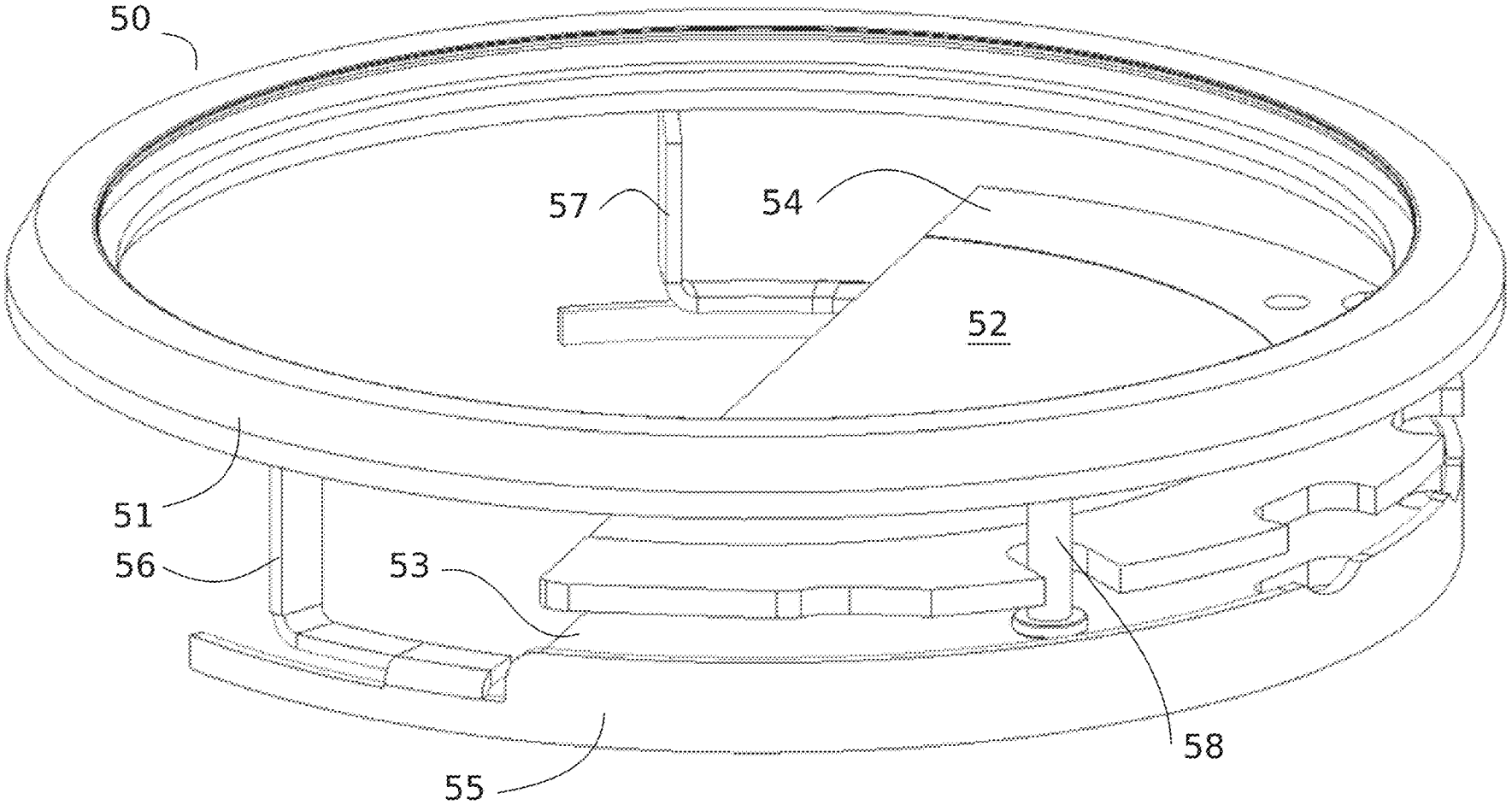
FIG. 5 shows an assembly for an antenna operating in a slot mode in accordance with at least some embodiments of the present invention.

FIG. 5 shows an assembly for an antenna operating in a slot mode which may be useful in some embodiments of the present invention. It is, according to some embodiments of the invention the effective width and/or length of the slot may be at least partially altered by conductive rim structures deposited on or attached to the ground plane of the circuit board and facing said conductive body. Such rim structures may comprise sheet metal parts etc. One example is shown in FIG. 5, with an assembly 50 that consists of a bezel ring 51, a first semi-circular PCB board 52 and a copper brim 54 arranged around the periphery of the PCB 52 as a ground plane, and a second semi-circular PCB board 53 arranged beneath the first PCB board 52. Attached to the second (lowermost) PCB board 53 is a sheet metal rim 55, which width (i.e. its height in relation to PCB 52) and length may be chosen to make it form part of a GPS slot antenna, together with the PCB 52 and the bezel 51. Slot defining members 56 and 57, which may serve as grounding pins defining the ends of the slot antenna, are shown between the sheet metal rim 55 and the bezel 51. A feed pin 58 is also shown.

Figure 6:
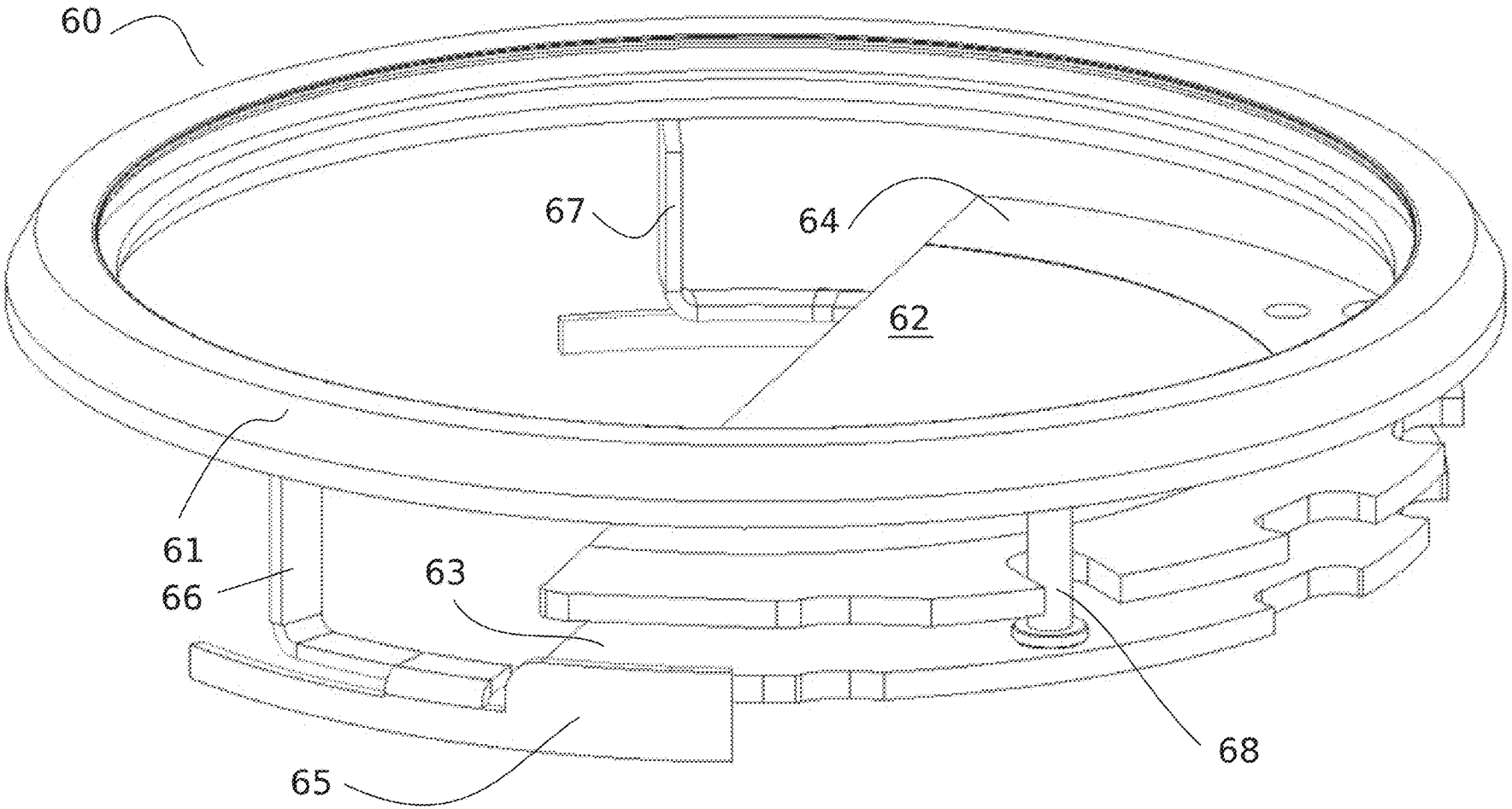
FIG. 6 shows an assembly for an antenna operating in a slot in accordance with at least some embodiments of the present invention.

FIG. 6 is a similar assembly to the one in FIG. 5, with parts 60-68 corresponding to parts 50-58 in FIG. 5. In FIG. 6, however, the metal sheet rim 65 is formed as an extension of a second lowermost PCB board 63. The rim extensions 65 may be connected to the copper brim 64 of the PCB 62 and/or to a copper brim (not shown) of the PCB 63. Again, the width (i.e. the height in relation to PCB 62) and length of the rim 65 may be chosen to make it form part of a GPS slot antenna, together with the PCB 62 and the bezel 61.

With reference to FIGS. 1 and 2, in some embodiments slot defining members 56 and 57 of FIG. 5, and slot defining members 66 and 67 of FIG. 6 may be referred to as connecting members. PCBs 52, 53, 62 and 63 may comprise multiple attachment points for each of the connecting members, but each connecting member may be coupled to only one attachment point at a time. Alternatively, or in addition, bezels 51 and 61 may comprise multiple attachment points for each of the connecting members.

Figure 7:
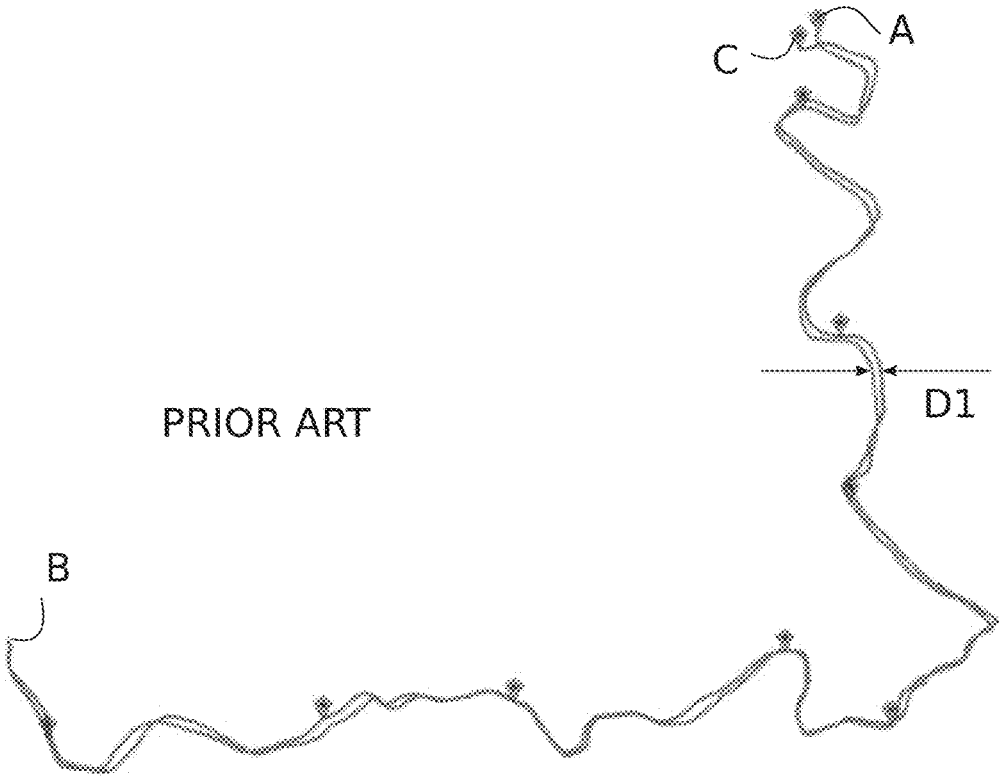
FIG. 7 shows the accuracy of a prior art GPS antenna.
Figure 8:
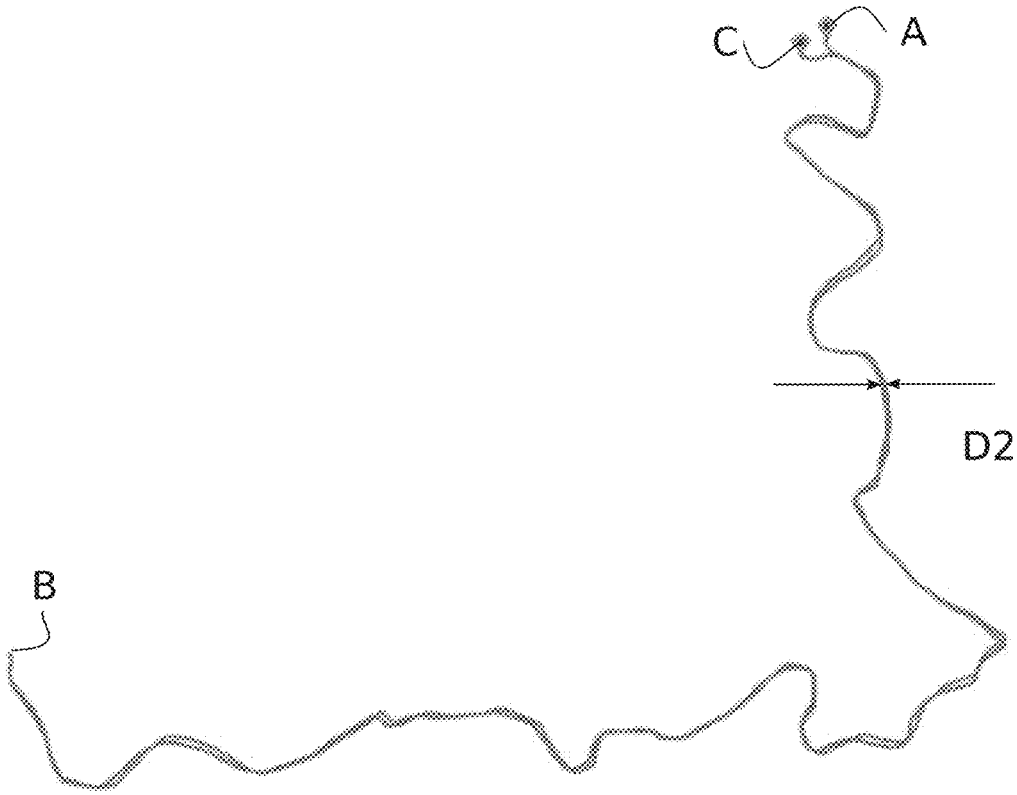
FIG. 8 shows the corresponding accuracy of an inventive slot mode GPS antenna in accordance with at least some embodiments.

In FIGS. 7 and 8 is shown the improved accuracy of the inventive slot mode antenna compared with antennas of prior art. In FIG. 7, a terrain round-trip route A-B-C was run by a person while the run was tracked by wristwatch-like GPS device having a prior art coupled radiator GPS antenna such as is known form e.g. US2017/0179581. A typical deviation at D1 between the different legs of the trip can be seen at many places along the route. In FIG. 8, where a device with similar performance, but using an inventive slot mode antenna, the deviation D2 is much smaller along the legs of the route A-B-C.

Figure 9B:
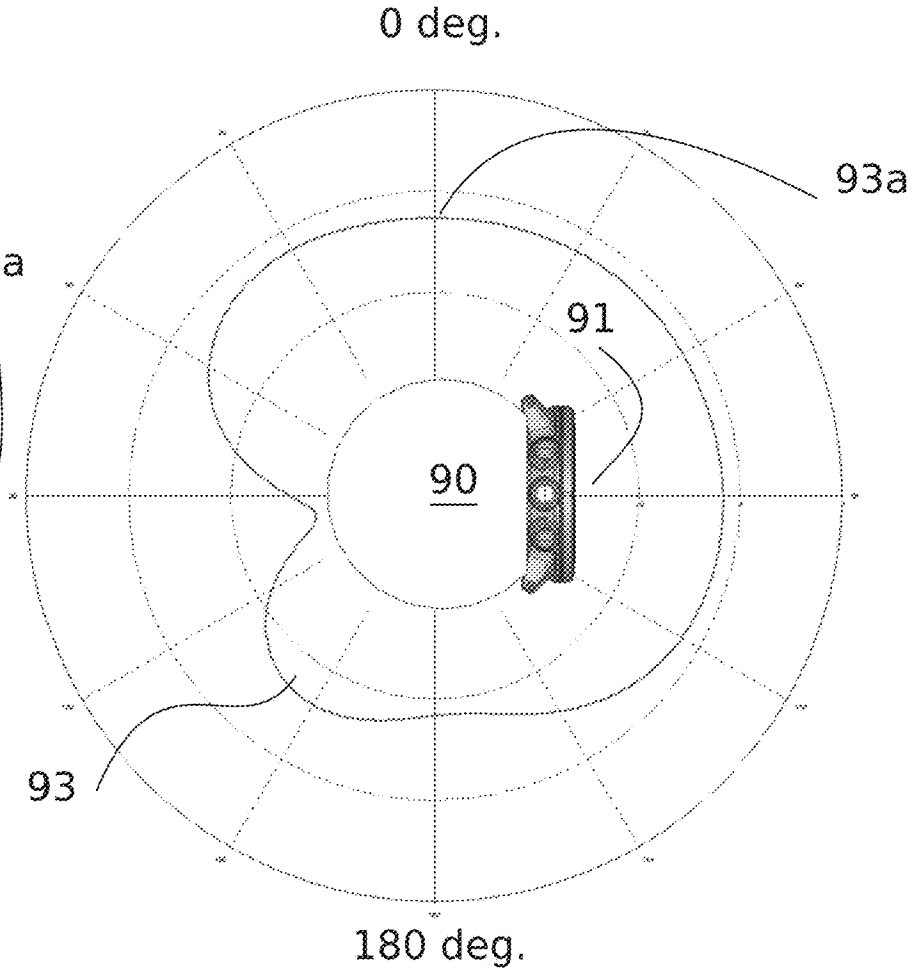
FIGS. 9A and 9B show the RHCP radiation patterns of a prior art and an inventive antenna in accordance with at least some embodiments.
Figure 9A:
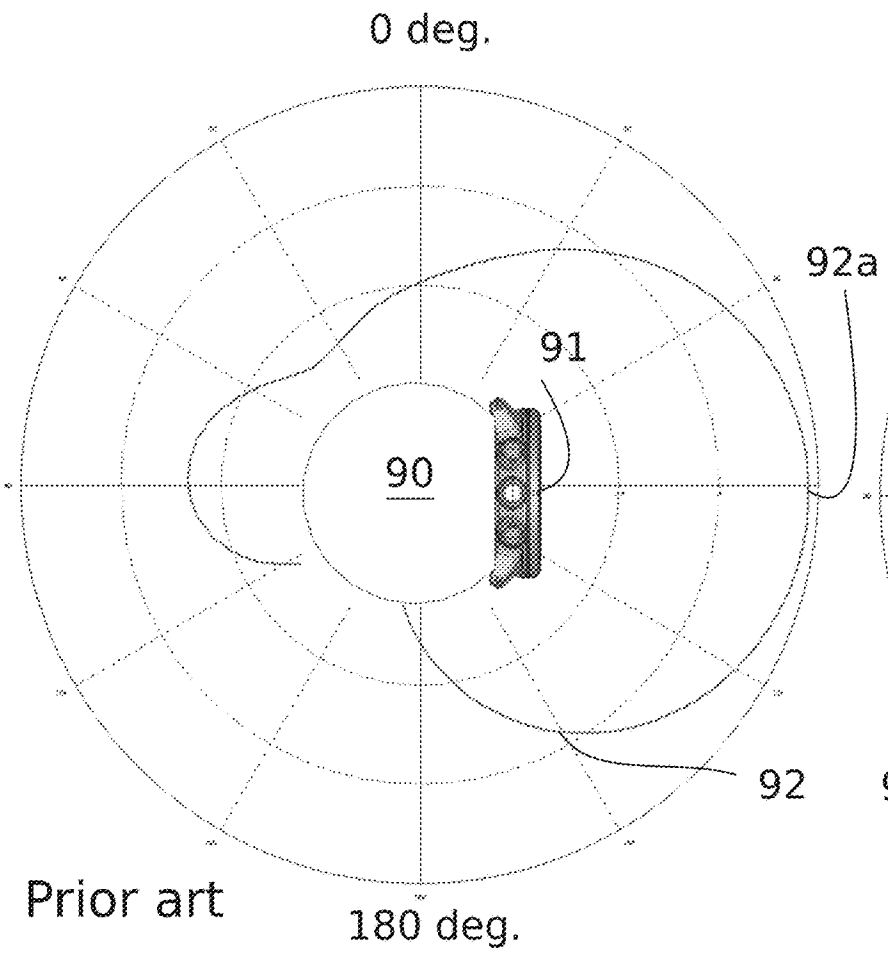
Prior art FIG. 9A

In FIGS. 9A and 9B are shown the corresponding RHCP radiation patterns in 2 dimensions (2D). A typical wristwatch-like GPS device 91 is carried on the wrist 90 of the left hand shown in a circular cross-section in both FIGS. 9A and 9B. A typical prior art antenna radiation pattern 92, using a conventional bezel antenna with radiating elements, for example, is shown in FIG. 9A. The peak 92*a* of the radiation pattern 92 is pointed in a lateral direction, and is less optimal in receiving an incoming satellite signal in the use position shown. The peak 93*a* of the radiation pattern 93 is pointing upwards, and is thus having a strong radiation field in the 0 degree direction when the device is in its most often used position.

It may be noted from FIGS. 9A and 9B that the slot antenna on FIG. 9B performs well also in a situation where the person wears the watch on the inside of the wrist. In this case the watch is turned upside down compared to FIG. 9B, but the slot antenna radiation pattern (shown here in the 180 degree direction) then pointing in the 0 degree direction will still be wider than the corresponding 0 degree direction pattern of the prior art bezel antenna in FIG. 9A.

Figure 10:
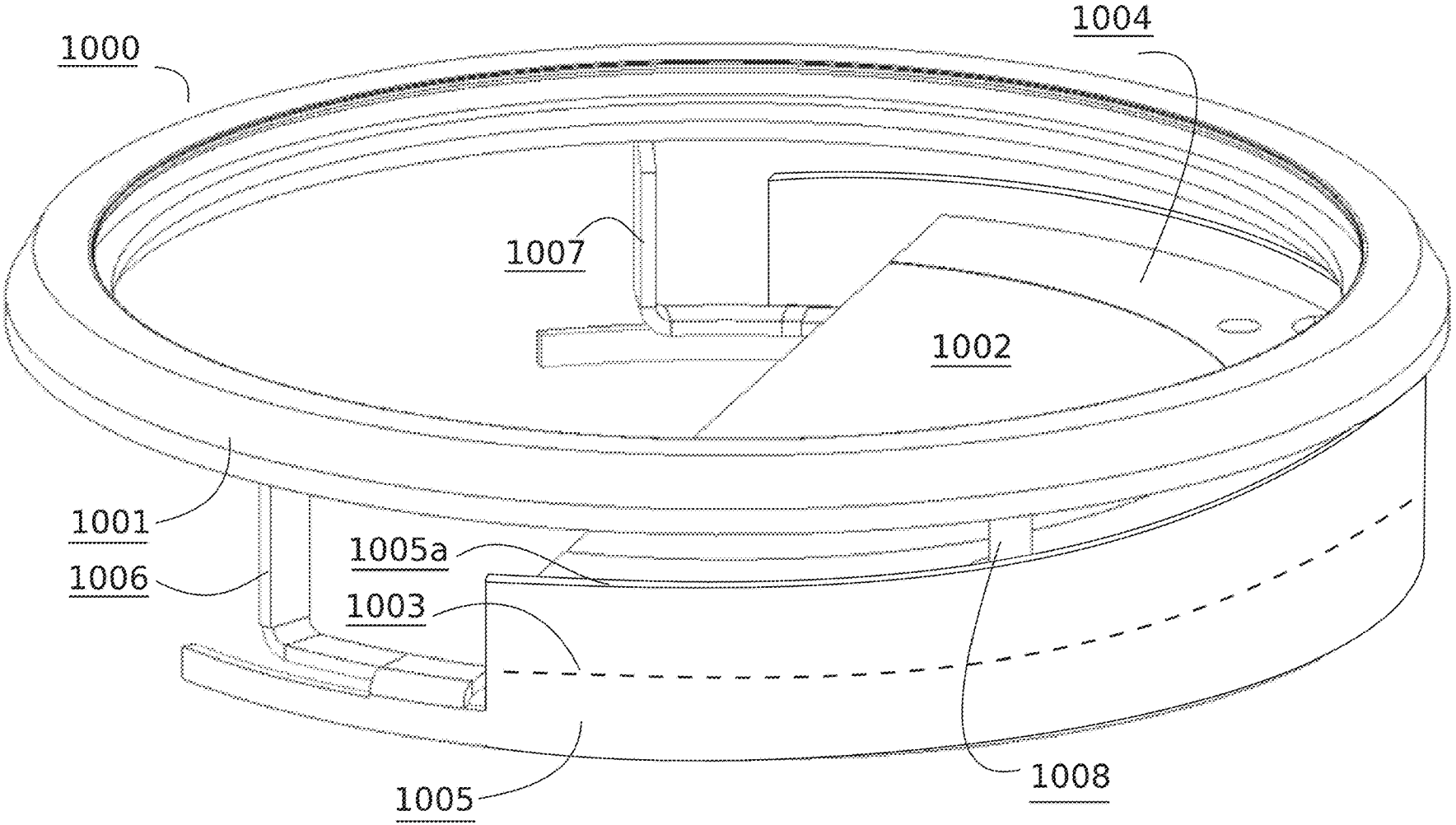
FIG. 10 shows an assembly for an antenna operating in a slot mode according to some embodiments of the present invention.

According to some embodiments of the present invention, the effective width and/or length of the slot may be completely defined by conductive rim structures deposited on or attached to the ground plane of the circuit board, and facing the conductive body. One example is shown in FIG. 10, with an assembly 1000 that consists of a bezel ring 1001, a semi-circular PCB board 1002 and a copper brim 1004 arranged around the periphery of the PCB 1002 as a ground plane. A second semi-circular PCB board 1003 (dashed line) may be arranged beneath the first PCB board 1002. Attached to the PCB boards is a sheet metal rim 1005 located along at least part of the periphery of the PCB 1002. The width and length of the rim 1005 may be chosen so that the upper edge 1005*a* of the rim forms a lower part of a GPS slot antenna, the bezel 1001 being the upper part. The metal rim may be in electrical contact with the grounded copper brim 1004, or it may have a different potential. Slot defining end members 1006 and 1007, which may serve as grounding pins, are shown between the sheet metal rim 1005 and the bezel 1001. A pin-like feed element 1008 is also shown, which at its one end connects to the ground plane 1004 of the PCB 1002, and at its other end to a conductive part of the slot mode antenna. This part may be the bezel 1001, the metal rim 1005, or some other part of the antenna where received radio waves have induced currents. The feed elements may take a multitude of shapes and be implemented in a variety of ways, as discussed above.

Figure 11:
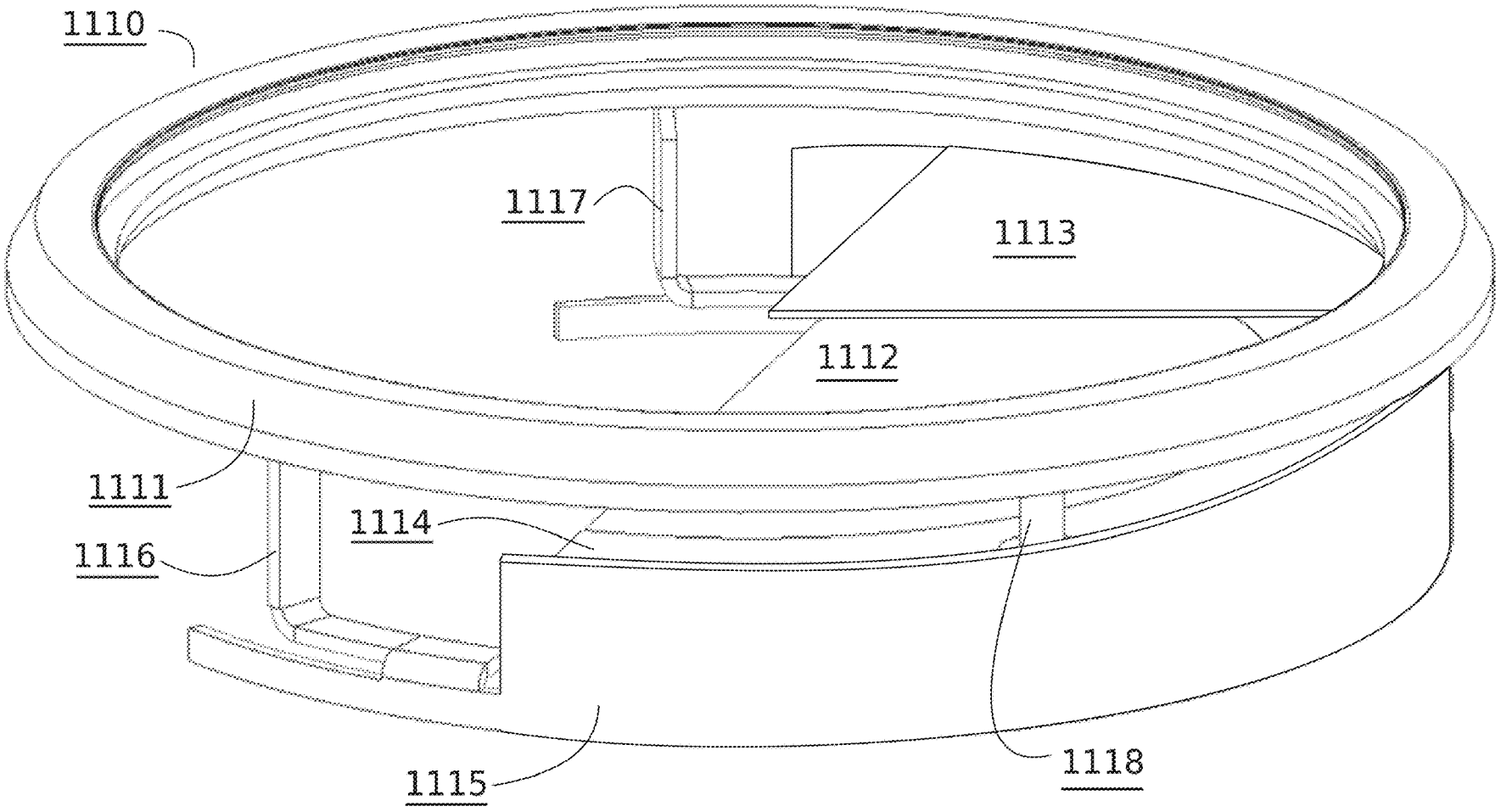
FIG. 11 shows an assembly for an antenna operating in a slot mode according to some embodiments of the present invention.

FIG. 11 is a similar assembly to the one in FIG. 10. In FIG. 11, however, the metal sheet rim 1115 has at least a partial cover 1113 formed on top of it, acting as an electromagnetic shield plate, such as a Faraday cage, for example. The plate 1113 may take various forms and sizes, but will form part of the second part 1115, 1113 of a GPS slot antenna, the bezel 1111 being the first part. A second semi-circular PCB board (not shown) may be arranged beneath the first PCB board 1112.

The metal rim 1115 and plate 1113 may be in electrical contact with the grounded copper brim 1114, or they may have a different potential. Slot defining end members 1116 and 1117, which may serve as grounding pins, are shown between the sheet metal rim 1115 and the bezel 1111.

In some embodiments of the present invention an assembly for an antenna operating in a slot mode may thus comprise at least one PCB 1002, 1112, a conductive body 1001, 1111 arranged at a distance from said PCB, and wherein at least one conductive rim structure 1005, 1115 located along at least part of the periphery of least one said PCB, wherein said conductive rim and said conductive body may define at least one slot mode antenna between themselves, and wherein a length of a slot mode antenna may be defined between two connection points, or connecting members, at which said conductive body is connected to said conductive rim, and wherein between said connection points, or connecting members, is located at least one feed element 1008, 1118 for coupling an electromagnetic signal from the slot mode antenna to said PCB.

With reference to FIGS. 1 and 2, in some embodiments slot defining members 1006, 1007 of FIG. 10, and slot defining members 1116, 1117 of FIG. 11 may be referred to as connecting members and PCBs 1002, 1112 may comprise multiple attachment points for each of the connecting members, however, each connecting member may be coupled to only one attachment point at a time. Also, in some embodiments of the present invention bezels 1001, 1111 may comprise multiple attachment points for each of the connecting members. Alternatively, or in addition, a second PCB 11 (not shown in FIG. 11) may comprise multiple attachment points for each of the connecting members. Also, in some embodiments of the present invention the metal rim 1005, 1115 may comprise multiple attachment points for each of the connecting members.

Figure 12:
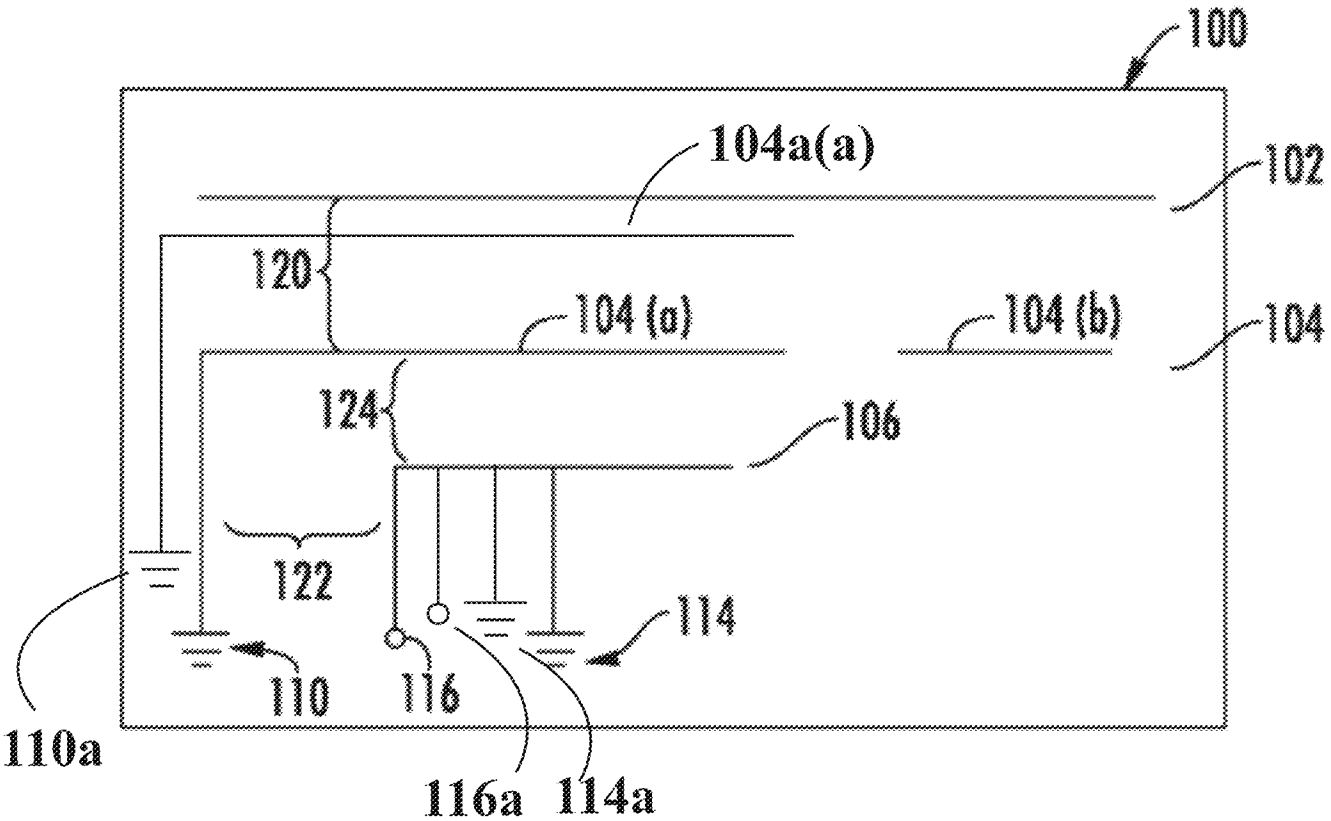
FIG. 12 illustrates a schematic diagram detailing an antenna assembly according to some embodiments of the present invention.

FIG. 12 illustrates a schematic diagram detailing an antenna assembly according to one embodiment of the disclosure. In FIG. 12, one exemplary embodiment of a coupled antenna apparatus 100 is shown and described in detail. As shown in FIG. 12, the coupled antenna apparatus 100 includes three (3) main antenna elements, including an outer element 102 that is disposed adjacent to a middle radiating element 104 and an inside feed element 106. The radiating element 104, feed element 106, and the outer element 102 are not in galvanic connection with one another, and instead are capacitively coupled as discussed below. The outer element 102 is further configured to act as the primary radiating element for the antenna apparatus 100. The width of the outer element and the distance of the outer element from the middle element are selected based on specific antenna design requirements, including (i) the frequency operating band of interest, and (ii) the operating bandwidth, exemplary values of which can be readily implemented by one of ordinary skill given the present disclosure.

As shown in FIG. 12, the middle radiating element of the coupled antenna apparatus is disposed adjacent the outer element, and is separated from the outer element by a gap distance 100. For example, in one implementation, a distance of 0.2-1 mm is used, but it will be appreciated that this value may vary depending on implementation and operating frequency. Moreover, the coupling strength can be adjusted by adjusting the gap distance and by adjusting the overlapping area of the outer and middle radiating elements and by the total area of both the outer and middle radiating elements. The gap 120 enables the tuning of, inter alia, the antenna resonant frequency, bandwidth, and radiation efficiency. The middle radiating element further comprises two parts 104(*a*) and 104(*b*). The first part 104(*a*) is the main coupling element, and the second part 104(*b*) is left floating and not otherwise connected to the antenna structure. The second part 104(*b*) can, for example, be left in the structure if for some mechanical reason the middle element is formed as a larger part, and only a shorter portion of it is needed as a coupling element. Disposed at one end of the middle radiating element part 104(*a*) is a short circuit point 110 for connecting the middle radiating element 104 to ground.

The short circuit point 110 is in the illustrated embodiment located at a predefined distance 122 (typically 1-5 mm in the exemplary implementations, but may vary depending on implementation and operating frequency) from the inside feed element 106. The placement of the short circuit point 110 determines in part the resonant frequency of the coupled antenna apparatus 100. Part 104(*a*) is connected to part 104(*b*), wherein part 104(*b*) forms the complete middle radiator (ring).

FIG. 12 also illustrates an inner feed element 106 comprised of a ground point 114, as well as a galvanically connected feed point 116. The inner feed element 106 is disposed at a distance 124 from the middle radiating element 104. Furthermore, the placement and positioning of the ground point 114 with respect to the feed point 116 determines in part the resonant frequency of the coupled antenna apparatus 100.

In general, the short circuit point 110, the ground point 114 and the feed point 116 may be referred to as connecting members which have a certain attachment point each. FIG. 12 also illustrates second locations 110*a*, 114*a* and 116*a* for connecting members 110, 114 and 116, respectively. Similarly as in the example of FIG. 1, the PCB may comprise second attachment points for connecting members 110*a*, 114*a* and 116*a*, however, the connecting members are coupled to only attachment point at a time. Alternatively, or in addition, a bezel (not shown in FIG. 12) may comprise second attachment points for connecting members 110*a*, 114*a* and 116*a*.

Thus, the gap 120 may be different depending on whether connecting member 110 or 110*a* (i.e., a short circuit point) is used. As the gap 120 enables the tuning of the antenna, the selection between the attachment points of connecting members 110 or 110*a* makes it possible to adjust the antenna to match a certain bezel, for example, while meeting regulatory radio requirements. So the attachment point of short circuit 110 may be used with a first bezel while the attachment point of short circuit 110*a* may be used with a second bezel. Similarly, the gap 122 may also change depending on whether connecting member 110 or 110*a* is used, but the gap 122 also depends on whether connecting member 116 or 116*a* is used. Similarly, the gap 124 may vary depending on whether connecting member 116 or 116*a* is used, and whether connecting member 114 or 114*a* is used. Naturally there may be more than two attachment points for each of the connecting members as well.

It is noted that the ground point of the feed element is primarily used for feed point impedance matching. In one implementation, the feed element forms and IFA-type (Inverted F Antenna) structure of the type known in the art, and impedance adjustment of such an element is well known by ordinary antenna designers, and accordingly not described further herein. A typical distance between the feed and ground points is on the order of 1-5 mm, but this may vary depending on frequency and application.

Moreover, it will be appreciated that the ground point may be eliminated if desired, such as by placing a shunt inductor onto the feed line. The placement, i.e., attachment point, of the feed point 116 and ground points 110 and 114 greatly affect RHCP and Left-Handed Circular Polarization (LHCP) isolation gains, as discussed below. As a brief aside, GPS and most satellite navigation transmissions are RHCP; satellites transmit the RHCP signal since it is found to be less affected by atmospheric signal deformation and loss than for example linearly polarized signals. Thus, any receiving antenna should have the same polarization as the transmitting satellite. Significant signal loss will occur (on the order of tens of dB) if the receiving device antenna is dominantly LHCP polarized. In addition the satellite signal will change polarization from RHCP to LHCP each time when it is reflected from an object, for example the earth's surface or a building. Signals that are reflected once near the receiving unit have almost the same amplitude but a small time delay and LHCP, as compared to directly received RHCP signals. These reflected signals are especially harmful to GPS receiver sensitivity, and thus it is preferred to use antennas in which LHCP gain is at minimum 5 dB to 10 dB lower than the RHCP gain.

The coupled antenna apparatus 100 of FIG. 12 thus comprises a stacked configuration comprising an outer element 102, a middle radiating element 104 disposed internal to the outer element, and an inside feed element 106. It is noted that one middle radiating element may be enough to excite on the desired operating frequency. However, for multiband operation, additional middle elements and feed elements may be added. If, as one example, a 2.4 GHz ISM band is needed, then the same outer radiator can be fed by another set of middle element and feed elements. The inside feed element may be further configured to be galvanically coupled with a feed point 116, and the middle radiating element may be configured to be capacitively coupled to the inside feed element. The outer element 102 may be configured to act as the final antenna radiator and is further configured to be capacitively coupled to the middle radiating element.

In the present embodiment, the dimensions of the outer element 102, and the feed elements 104 and 106 may be selected to achieve a desired performance. Specifically, if the elements (outer, middle, inner) are measured as separated from each other, none of them would be independently tuned to a value close to the desired operating frequency. When the three elements are coupled together, however, they may form a single radiator package that creates resonances in the desired operating frequency (or frequencies). A relatively wide bandwidth of a single resonance is achieved due to the physical size of the antenna, and use of low dielectric mediums like plastic. One salient benefit of this structure in the exemplary context of satellite navigation applications is that there is a typical interest in covering both GPS and GLONASS navigation systems with same antenna, i.e., 1575-1610 MHz at minimum, which the exemplary implementation allows.

Referring now to FIGS. 13A-13C, one embodiment of a coupled antenna apparatus 200 for use in a portable radio device in accordance with the principles of the present disclosure is shown. FIG. 13A illustrates the underside of the coupled antenna apparatus 200 illustrating the various connections made to a printed circuit board (219, FIGS. 13B and 13C). Specifically, FIG. 13A illustrates short circuit point 210 for the middle ring radiating element 204 as well as the short circuit point 216 and galvanic feed point 214 for the inner feed trace element 206. Both the inner feed trace element and middle ring radiating element may be disposed internal to the front cover 203 of the illustrated embodiment for the coupled antenna apparatus for use with a portable radio device. The front cover 203 (see FIGS. 13A and 13C) may be manufactured using a Laser Direct Structuring (LDS) polymer material that is subsequently doped and plated with an outer ring radiating element 202 (see FIGS. 13B-13C). The use of LDS technology is exemplary in that it allows complex (e.g. curved) metallic structures to be formed directly onto the underlying polymer material.

In addition, the middle ring radiating element 204 may be disposed on the inside of the doped front cover 203 using LDS technology as well in an exemplary embodiment. The middle ring radiating element 204 may be constructed into two (2) parts 204(*a*) and 204(*b*). In an exemplary implementation, element 204(*a*) may be used to provide a favorable place for the ground contact (short circuit point) 210 to mate. The short circuit point 210 is disposed on one end of the first part 204(*a*) of middle ring radiator. Coupled antenna apparatus 200 further includes an LDS polymer feed frame 218 onto which an inside feed element 206 is subsequently constructed. The inside feed element comprises a galvanic feed point 216 as well as a short circuit point 214, both of which are configured to be coupled to a printed circuit board 219 at points 216' and 214', respectively (see FIG. 13C).

The inside feed frame element is disposed adjacent to the middle radiator ring element part 204 such that coaxial feed point is at a distance 222 from the middle radiating element short circuit point 210. Short circuit points 210 of the middle radiating element and 214 of the inside feed element are configured to interface with the PCB 219 at points 210' and 214', respectively. A back cover 220 is positioned on the underside of the printed circuit board and forms the closed structure of the coupled antenna apparatus.

Points 210', 214' and 216' may be referred to as attachment points, which couple the connecting members, i.e., short circuit point 210, short circuit board 214 and galvanic feed point 216 to the PCB 219. In FIG. 13C, second attachment points for connecting members 210, 214 and 216 are illustrated by 210', 214' and 216', respectively. Thus, connecting members 210, 214 and 216 may be coupled to two different attachment points at different times for adjusting the operation of the antenna. Again, PCB 219 may comprise multiple attachment points for each of the connecting members, but each connecting member may be coupled to only one attachment point at a time. Alternatively, or in addition, a bezel may comprise multiple attachment points for each of the connecting members.

Moreover, in some embodiments of the present invention the coupled antenna apparatus 200 may differ from the embodiment of FIGS. 13-13C in that an inside fed element 206 may be subsequently constructed directly onto the inside of front cover 203, rather than being formed on a separate feed frame. The inside feed element comprises a galvanic feed point as well as a short circuit point, both of which are configured to be coupled to a printed circuit board at points and, respectively. A back cover is positioned on the underside of the printed circuit board and forms the closed structure of the coupled antenna apparatus.

In some embodiments, the coupled antenna apparatus 200 may comprise one elongate strip, e.g., an inverted-F antenna, and a housing. Said elongate strip may be made of conductive material and it may be connected to the PCB with at least one connecting member, i.e., electrically conductive component, such as a pogo pin. Said at least one connecting member may pass through the housing. The PCB may be within the housing. Said elongate strip may be used for receiving signals and transferring the signals to at least one component within said housing.

A portion of said elongate strip may go through an opening. Said opening may be located in a wall of the housing. That is to say, a first portion of said elongate strip may be located on an external surface of the housing. For example, the first portion of said elongate strip may be integrated with a part of a bezel on an upper surface of the housing. A second portion of said elongate strip may be located inside the housing, i.e., in an internal cavity of the housing. Said elongate strip may be an inverted-F antenna, which goes from the internal cavity to the external surface of the housing through the opening in the wall of the housing.

An antenna assembly may comprise multiple attachment points for an elongate strip. Said elongate strip may be made of a conductive material. The antenna assembly may comprise a housing and said housing may comprise multiple attachment points at which said elongate strip is connectable to said housing, possibly on the external surface of the housing. Alternatively, or in addition, a circuit board may comprise multiple attachment points at which said elongate strip is connectable to said circuit board.

It will be recognized that while certain aspects of the present disclosure are described in terms of a specific sequence of steps of a method, these descriptions are only illustrative of the broader methods of the disclosure, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the disclosure disclosed and claimed herein.

While the above detailed description has shown, described, and pointed out novel features of the antenna apparatus as applied to various embodiments, it will be understood that various omissions, substitutions, and changes in the form and details of the device or process illustrated may be made by those skilled in the art without departing from the fundamental principles of the antenna apparatus. The foregoing description is of the best mode presently contemplated of carrying out the present disclosure. This description is in no way meant to be limiting, but rather should be taken as illustrative of the general principles of the present disclosure. The scope of the present disclosure should be determined with reference to the claims.

The invention claimed is:

1. An assembly for an antenna, wherein the assembly comprises at least one circuit board of an electronic device, a conductive body arranged at a distance from said at least one circuit board, and an element of said antenna which comprises multiple attachment points for at least one connecting member, and said at least one connecting member is coupled to only one of said multiple attachment points at a time, wherein the assembly for the antenna is adjustable to suit different components by changing coupling of the at least one connecting member from one of said multiple attachment points to another.

2. The assembly according to claim 1, wherein the assembly comprises at least two connecting members and said element of said antenna comprises multiple attachment points for each of the at least two connecting members.

3. The assembly according to claim 1, wherein said antenna is operating in a slot mode and said element of said antenna is said at least one circuit board, comprising said multiple attachment points at which said at least one circuit board is connectable to said conductive body.

4. The assembly according to claim 1, wherein said antenna is operating in a slot mode and said element of said antenna is said conductive body, comprising said multiple attachment points at which said conductive body is connectable to said at least one circuit board.

5. The assembly according to claim 1, wherein the assembly further comprises at least one conductive rim structure located along at least part of the periphery of said at least one circuit board, and said element of said antenna is said at least one conductive rim, comprising said multiple attachment points at which said at least one circuit board is connectable to said conductive body.

6. The assembly according to claim 1, wherein between said attachment points of said at least two connecting members is located at least one feed element for coupling an electromagnetic signal between at least one slot mode antenna and said circuit board.

7. The assembly according to claim 1, wherein said element of said antenna is a plastic part comprising said multiple attachment points at which said conductive body is connectable to said at least one circuit board or to at least one conductive rim.

8. The assembly according to claim 2, wherein said connecting member comprises a connection point for grounding said conductive body to a ground plane of said circuit board and/or a slot defining member serving as grounding pins and defining the ends of the slot antenna.

9. The assembly according to claim 1, wherein the assembly further comprises at least one elongate strip of a conductive material and said element of said antenna is said at least one circuit board comprising said multiple attachment points at which said at least one elongate strip is connectable to said at least one circuit board.

10. The assembly according to claim 1, wherein said connecting member comprises a short circuit point associated with a middle radiating element, galvanic feed point associated with an inner feed element and/or a ground point associated with the inner feed element.

11. The assembly according to claim 1, wherein said conductive body is a bezel being a part of the housing encompassing a wristwatch-like device.

12. The assembly according to claim 1, wherein said conductive body has the shape of a ring, an ellipse, a rectangle, a square, or any other polygon.

13. The assembly according to claim 1, wherein the assembly is adapted for the reception of a GNSS (Global Navigation Satellite System), Wi-Fi or Bluetooth signal.

14. The assembly according to claim 13, wherein said GNSS signal is selected from GPS, Glonass, Galileo and/or Beidou signals.

15. An electronic wristwatch-like device comprising at least one circuit board, a conductive body arranged at a distance from said at least one circuit board, and an element of said antenna which comprises multiple attachment points for at least one connecting member, and said at least one connecting member is coupled to only one of said multiple attachment points at a time, wherein the assembly for the antenna is adjustable to suit different components by changing coupling of the at least one connecting member from one of said multiple attachment points to another.

16. The device according to claim 15, wherein the device comprises at least two connecting members and said element of said antenna comprises multiple attachment points for each of the at least two connecting members.

17. The device according to claim 15, wherein said antenna is operating in a slot mode and said element of said antenna is said at least one circuit board, comprising said multiple attachment points at which said at least one circuit board is connectable to said conductive body.

18. The device according to claim 15, wherein said antenna is operating in a slot mode and said element of said antenna is said conductive body, comprising said multiple attachment points at which said conductive body is connectable to said at least one circuit board.

19. The device according to claim 15, further comprising at least one conductive rim structure located along at least part of the periphery of said at least one circuit board, and said element of said antenna is said at least one conductive rim, comprising said multiple attachment points at which said at least one circuit board is connectable to said conductive body.

20. The device according to claim 15, wherein between said attachment points of said at least two connecting members is located at least one feed element for coupling an electromagnetic signal between at least one slot mode antenna and said circuit board.

21. The device according to claim 15, wherein said element of said antenna is a plastic part comprising said multiple attachment points at which said conductive body is connectable to said at least one circuit board or to at least one conductive rim.

22. The device according to claim 15, wherein said connecting member comprises a connection point for grounding said conductive body to a ground plane of said circuit board and/or a slot defining member serving as grounding pins and defining the ends of the slot antenna.

23. The device according to claim 15, wherein the device further comprises at least one elongate strip of a conductive material and said element of said antenna is said at least one circuit board comprising said multiple attachment points at which said at least one elongate strip is connectable to said at least one circuit board.

24. The device according to claim 15, wherein said connecting member comprises a short circuit point associated with a middle radiating element, galvanic feed point associated with an inner feed element and/or a ground point associated with the inner feed element.

25. The device according to claim 15, further comprising an assembly for an antenna, wherein the assembly comprises at least one circuit board of an electronic device, a conductive body arranged at a distance from said at least one circuit board, and an element of said antenna which comprises multiple attachment points for at least one connecting member, and said at least one connecting member is coupled to only one of said multiple attachment points at a time.

* * * * *